US006951090B2

(12) United States Patent
Kondo et al.

(10) Patent No.: US 6,951,090 B2
(45) Date of Patent: Oct. 4, 2005

(54) PACKAGING MACHINE

(75) Inventors: Masashi Kondo, Ritto (JP); Yukio Sasaki, Ritto (JP); Makoto Ichikawa, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 10/886,291

(22) Filed: Jul. 6, 2004

(65) Prior Publication Data

US 2005/0188660 A1 Sep. 1, 2005

(30) Foreign Application Priority Data

Feb. 26, 2004 (JP) ..... 2004-050767

(51) Int. Cl.[7] ..... B65B 9/20
(52) U.S. Cl. ..... 53/551; 53/552; 493/302
(58) Field of Search ..... 53/551, 552; 493/302

(56) References Cited

U.S. PATENT DOCUMENTS 2,899,875 A * 8/1959 Leasure ..... 493/302
3,125,008 A * 3/1964 Herdina ..... 493/302
5,732,532 A * 3/1998 Fujisaki et al. ..... 53/451
5,755,082 A * 5/1998 Takahashi et al. ..... 53/551
6,052,970 A * 4/2000 Fujimoto et al. ..... 53/451
6,619,018 B1 * 9/2003 Sasaki ..... 53/551
6,735,928 B2 * 5/2004 Kondo et al. ..... 53/552

FOREIGN PATENT DOCUMENTS

JP 2001-206312 7/2001

* cited by examiner

*Primary Examiner*—John Sipos
(74) *Attorney, Agent, or Firm*—Beyer Weaver & Thomas LLP

(57) ABSTRACT

A packaging machine has a former with a guiding member and tube for forming an elongated bag-making material into a tubular form, a longitudinal sealer disposed on the front side of the tube for sealing mutually overlapping side edge parts of the tubularly formed bag-making material in a longitudinal direction and a transverse sealer for sealing the longitudinally sealed bag-making material in a transverse direction transverse to the longitudinal direction to thereby package articles dropped down. The tube has a conical part at the top and a cylindrical part extending downward from the conical part. The cylindrical part has an opening on the back side such that articles dropped through the interior of the tube can directly contact the bag-making material and will be prevented from becoming clogged. An unopened part may be provided to the cylindrical part of the tube below the opening in order to maintain a circular cross-sectional shape of the bag-making material.

4 Claims, 5 Drawing Sheets

PACKAGING MACHINE

Priority is claimed on Japanese Patent Application 2004-050767 filed Feb. 26, 2004.

BACKGROUND OF THE INVENTION

This invention relates to a packaging machine of the form-fill-seal type and more particularly to a vertical pillow type form-fill-seal packaging machine adapted to form an elongated bag-making material into a tubular form as articles to be packaged are dropped in and sealed in.

It has been known to use a vertical pillow-type packaging machine of this kind to package snack food such as potato chips. Such a packaging machine is provided with a former having a lapel-like guiding member and a tube, serving to form an elongated bag-making material into a tubular shape by means of the guiding member such that its side edges will overlap one on top of the other and guiding it to the tube. The tube is comprised of a conical member which has a wider open part at the top and a cylindrical member which extends downward from its top at which it connects to the bottom of the conical member. The bag-making material is transported downward by means of a pull-down belt along the outer surface of the cylindrical member while its side edges are sealed together longitudinally so as to make it into a tubular form. A transverse sealer is provided below the cylindrical member for sealing the tubularly formed bag-making material transversely to form the bottom of a bag and to cut off the portion of the bag-making material below the sealed position. After a specified quantity of articles to be packaged is dropped in through the conical member and contained inside the bag-making material, it is again sealed across its top part to produce a package having the articles sealed inside.

When relatively light but bulky articles such as potato chips are packaged, furthermore, such articles tend to get stuck especially near the junction between the aforementioned conical and cylindrical members. In view of such a problem, Japanese Patent Publication Tokkai 2001-206312, for example, disclosed a half-tube 100 as shown in FIG. 11 with a half portion of its cylindrical member 110 removed, as more clearly shown cross-sectionally in FIG. 12. As an elongated bag-making material F is introduced from above and transported downward along the outer surface of the cylindrical member 110, the material F can directly contact the articles and hence exert a downward force to prevent the clogging by the articles.

Japanese Patent Publication Tokko 3-17694 disclosed a bag-making packaging machine comprising a bar-shaped guiding member for introducing a bag-making material and a pair of perpendicularly disposed bar-shaped members that approach or cross each other on the downstream side for forming a bag by reducing the contact area size with the bag-making material.

When the bag-making material F is clamped by the transverse sealer 120 of the bag making machine as shown in FIG. 13, however, the portion of the material F on the open side becomes pulled towards the inside such that its effective cross-sectional area becomes reduced as shown in FIG. 14. Moreover, since the speed of the material F at which it is being pulled downward is much slower than the speed at which the articles are being dropped, the articles X being dropped inside the material F tend to be decelerated by the material F such that their length of spread L' may increase as shown in FIG. 15. This may cause some of the articles to be caught by the transverse sealer 120, which begins to close before the articles X are completely dropped. In such a situation, if it is attempted to increase the production pitch, or to reduce the time intervals between successive supplying of articles X, the time length allowed for performing transverse sealing correctly is adversely affected. In other words, the production cannot be increased as desired in such a situation.

Another problem with the use of a half-tube 100 is that the articles tend to become oriented vertically when they settle inside the bag because of its narrowed cross-sectional area through which they must drop. This causes the products to be unsightly and it becomes necessary to carry out the stripping operation more intensely.

Similar problems are also encountered with a packaging machine according to aforementioned Japanese Patent Publication Tokko 3-17694.

SUMMARY OF THE INVENTION

It is therefore an object of the invention to provide a packaging machine designed such that articles being dropped in are not easily caught by the transverse sealer and that packages with improved appearance can be produced.

A packaging machine embodying this invention may be characterized not only as comprising a former having a guiding member and a tube connected to the guiding member for forming an elongated bag-making material into a tubular form, a longitudinal sealer disposed on a front side of the tube for sealing mutually overlapping side edge parts of the tubularly formed bag-making material in a longitudinal direction, and a transverse sealer for sealing the longitudinally sealed bag-making material in a transverse direction transverse to the longitudinal direction to thereby package articles dropped down through the tube, but also wherein the tube has a conical part which expands conically upward and a cylindrical part which is connected to and extends downward from the conical part, the cylindrical part having an opening on a back surface, the opening extending downward from an upper part of the cylindrical part proximal to the conical part, and the cylindrical part having an unopened part near a lower end part.

With a packaging machine thus structured, articles and the downwardly moving bag-making material contact directly near the boundary between the conical part and the tube where the articled tend to get clogged. This is because the tube is provided with an opening on its backside from a top end near the boundary downward. As a result of this direct contact, bridges that may have been formed inside the bag-making material are easily broken up as the bag-making material is pulled downward.

In the above, the unopened part means a part of the cylindrical part where the opening serving to make it possible for the falling particles to directly contact the bag-making material is not formed and hence the cylindrical part substantially entirely surround the tubularly formed bag-making material. Because of such an unopened part, the bag-making material is caused to maintain its circular cross-sectional form without reducing its inner cross-sectional area. This further serves to reduce the possibility of the articles clogging the interior of the bag-making material or forming bridged therein. As a result, the articles are more likely to fall smoothly and their charge length becomes shorter, reducing further the possibility of any of the articles becoming caught by the transverse sealer as the latter closes on the bag-making material for transverse sealing. This is in contrast to the prior art technology of using a half-tube as described above and the articles are prevented from remaining oriented vertically as they are packaged although no extra operations such as stripping are carried out.

The upper edge of the unopened part that substantially encircles the bag-making material is preferably formed so as to be sloped. With the upper edge of the unopened part thus formed, articles that contact the upper edge tend to be guided downward and inward, and this further serves to prevent the clogging of the interior of the bag-making material.

It is further preferable to provide a small gap to the unopened part, connecting the opening thereabove with the lower edge of the unopened part. With such a gap provided, articles which may become stuck on the upper edge of the unopened part can be dropped through the gap.

DETAILED DESCRIPTION OF THE INVENTION

Figure 1:
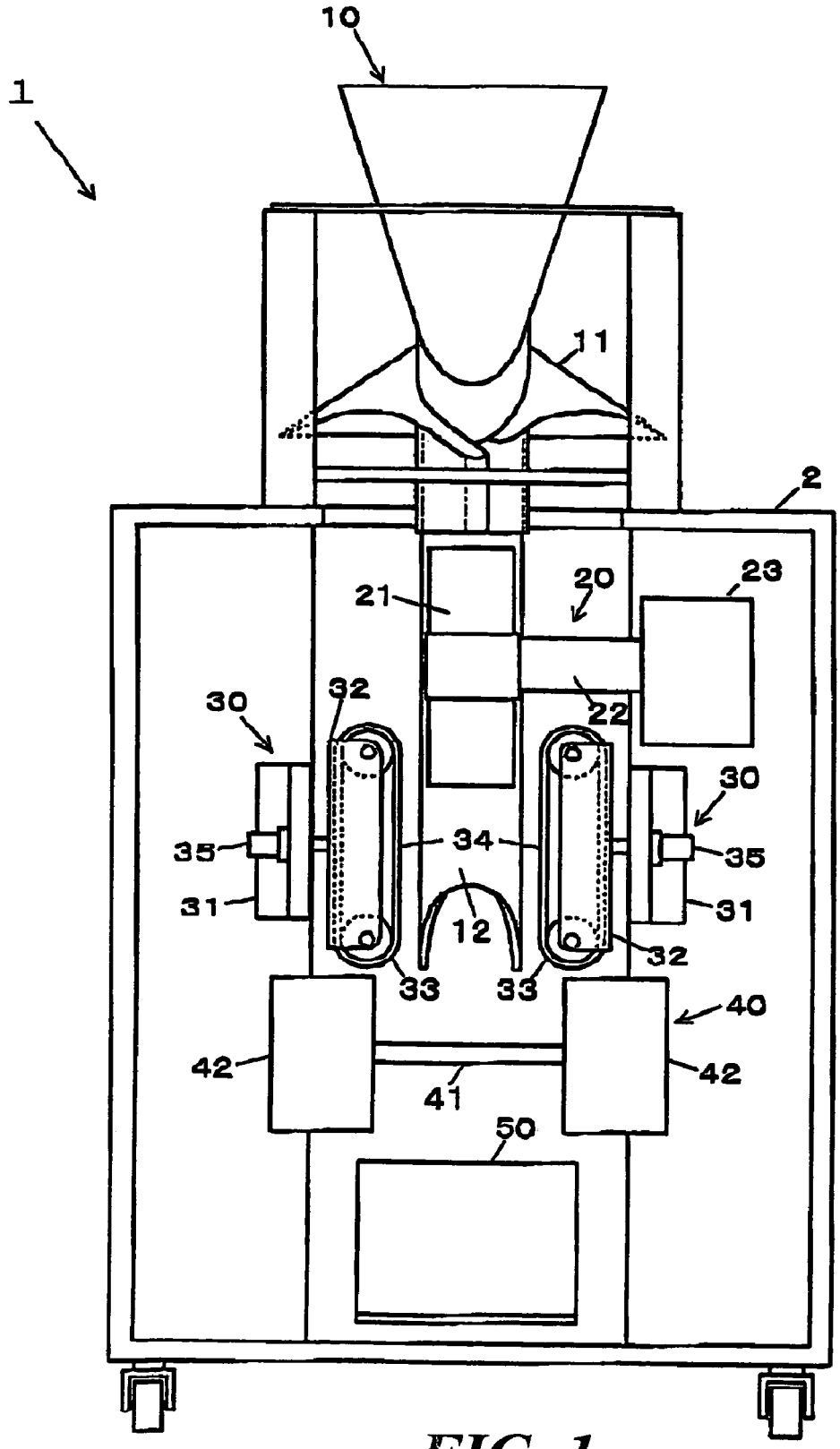
FIG. 1 is a front view of a packaging machine embodying this invention.

FIG. 1 shows a packaging machine 1 embodying this invention with a roll holder (not shown) at an elevated position behind its machine frame 2 for holding a film roll rotatably. At an elevated position on the front side of frame 2 is a former 10 for guiding an elongated bag-making material (herein after referred to as the film (not shown)) pulled forward out of the film roll into a downward direction while bending it into a tubular shape by overlapping its side edges one on top of the other. The former 10 is comprised of a lapel-shaped guiding member 11 for bending the incoming film into the tubular form as explained above and a cylindrical part (the "tube") 12 for accepting from above into its interior the film which has been bent into the tubular form by means of the guiding member 11 and allowing articles to be dropped inside the tubular film.

In front of the tube 12 is a longitudinal sealer 20 for sealing together the mutually overlapped side edges of the film. The longitudinal sealer 20 is comprised of a heater 21 for thermally sealing the side edges of the film together, a heater supporting unit 22 for supporting the heater 21 and a driver mechanism 23 for moving from the heater supporting unit 22 to the heater 21 towards and away from the tube 12.

On both sides of the tube 12 is a pair of pull-down belts 30 serving as the means for transporting the film provided so as to sandwich the tube 12 therebetween. Each pull-down belt 30 includes a pair of upper and lower rollers 33 on an attachment plate 32 supported by the machine frame 2, a belt member 34 wound over these rollers 33 to push the film onto one of the side surfaces of the tube 12 and a motor (not shown) for causing the rollers 33 to rotate so as to cause the film to move downward. Each pull-down belt 30 is adapted to move towards and away from the tube 12 by means of an air cylinder 35 as its driving means.

Directly below the tube 12 is a transverse sealer 40 comprised of a pair of bar members 41 (only one of them being shown) in front of and behind the tube 12 and support units 42 for supporting the bar members 41 so as to move them horizontally forward and backward, or towards and away from the film in between. The bar members 41 are heated by heaters (not shown) and serve to thermally seal the film transversely. In other words, for each bag that is produced, its upper and lower edges are sealed thereby. As the pair of bar members 41 seal the film transversely over a seal area, a cutter (not shown) incorporated in one of the pair serves to cut the film in the transverse direction at the center of the seal area so as to separate into the upper and lower bags.

Below the machine frame 2 is a table 50 for holding produced packages thereon.

Figure 2:
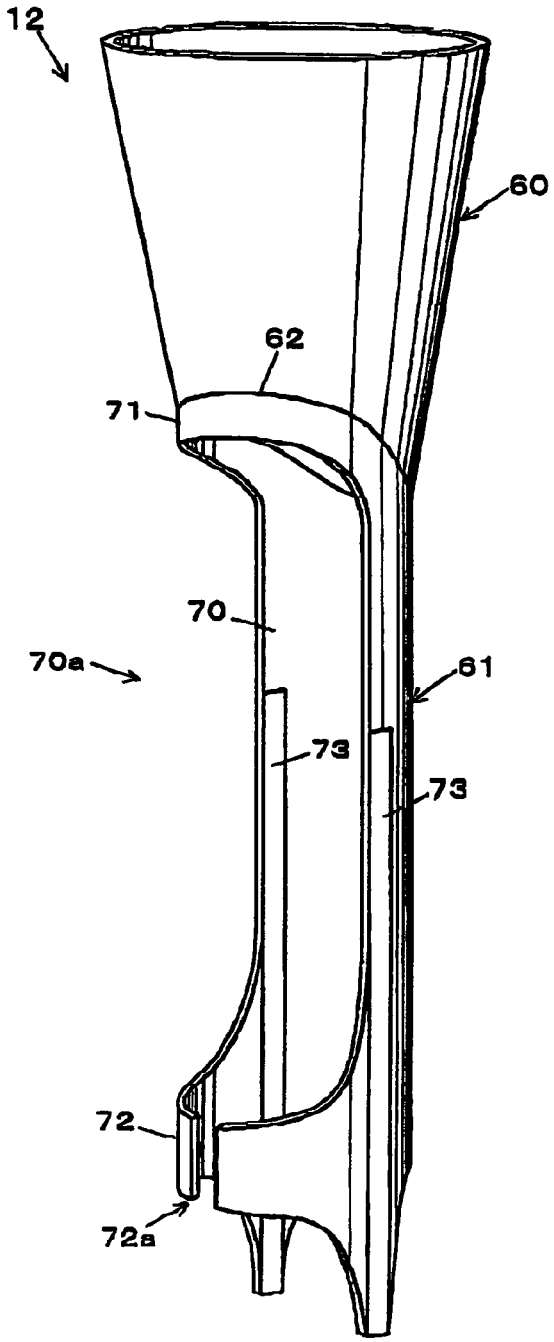
FIG. 2 is a diagonal back view of the tube of the packaging machine of FIG. 1.
Figure 3:
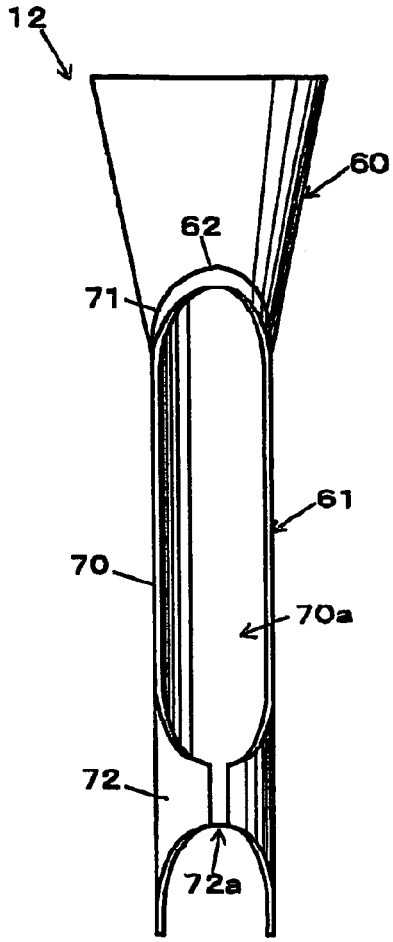
FIG. 3 is a back view of the tube.
Figure 4:
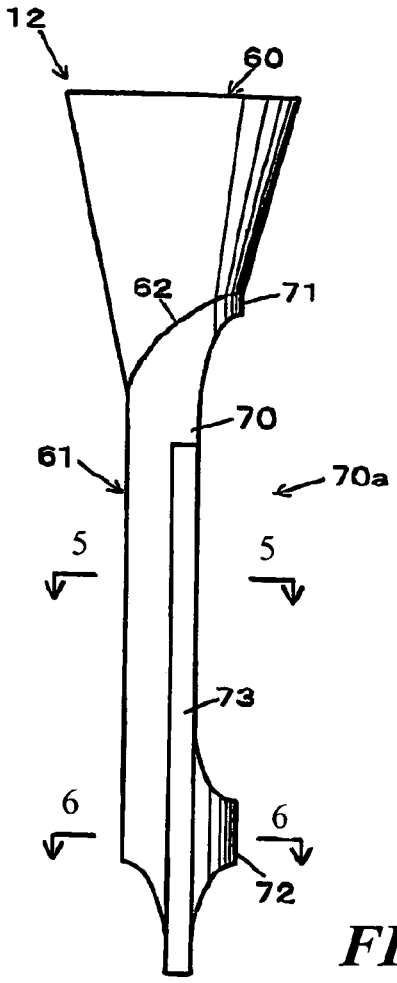
FIG. 4 is a side view of the tube.

FIGS. 2, 3 and 4 are referenced next to explain the structure of the tube 12 more in detail.

The tube 12 has a conical part 60 which becomes wider conically in the upward direction at the top such that articles to be packaged can be easily introduced therein and a cylindrical part 61 which is connected to the lower end of the conical part 60 and extend downward therefrom to serve to guide (or to allow to fall) the articles received through the conical part 60 to the vicinity of the transverse sealer 40. The junction surface at which the conical part 60 and the cylindrical part 61 are connected is indicated by numeral 62 and is designed so as to be higher at the back than in front. In other words, the lower end of the conical part 60 and the upper end of the cylindrical part 61 are designed such that the function surface 62 satisfies this condition.

Figure 5:
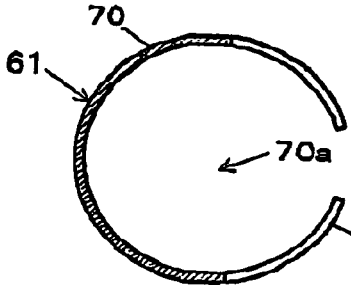
FIG. 5 is a sectional view taken along line 5—5 of FIG. 4.

The cylindrical part 61 is characterized as having an open part 70 provided with an opening 70*a* facing backward, extending downward from the neighborhood of its upper end (that is, near the junction surface 62). The opening 70*a* is provided such that the open part 70 has an approximately semi-circular sectional shape, as shown in FIG. 5 but does not reach either the top end or the bottom end of the cylindrical part 61. In other words, there remains at the top a cylindrical upper portion 71 that connects to the conical part 60, and there is also a nearly completely cylindrical portion 72 near the bottom of the cylindrical part 61 of the tube 12.

Figure 6:
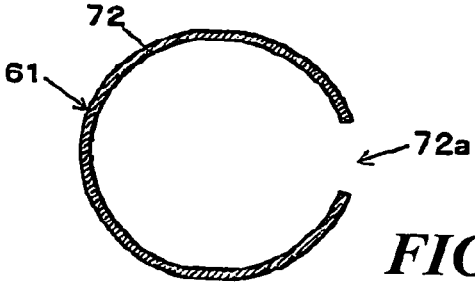
FIG. 6 is a sectional view taken along line 6—6 of FIG. 4.

The aforementioned nearly completely cylindrical portion 72 has a vertical cut 72*a* but this cut 72*a* is much narrower than the opening 70*a* of the open part 70, as shown in FIG. 6. On both external side surfaces of the cylindrical part 61 is a flat area 73 such that the belt members 34 of the pull-down belts 30 can contact them and dependably pull down the film in between.

Next, the operation of the packaging machine 1 is described.

To start, the film unrolled from the film roll is pulled horizontally past the upper part of the packaging machine 1 and bent downward by means of the guiding member 11 such that it becomes tubular with its side edges overlapping. The tubularly formed film is wound around the cylindrical part 61 of the tube 12 and its side edges are sealed together by the heater 21 of the longitudinal sealer 20. It is pulled downward at a specified timing by means of the pull-down belts 30.

The transverse sealer 40 serves to seal the tubularly formed film transversely twice for each bag and cuts it by the cutter incorporated therein. After the bottom of a bag is sealed, it is pulled down by a specified distance by the pull-down belts 30 and then a batch of articles to be packaged is dropped through the conical part 60 above. These articles pass through the cylindrical part 61 to the bottom of the bag being formed. Thereafter, the top end of the bag is sealed by the transverse sealer 40 and the filled bag is cut from the film by the cutter and discharged onto the table 50.

Figure 7:
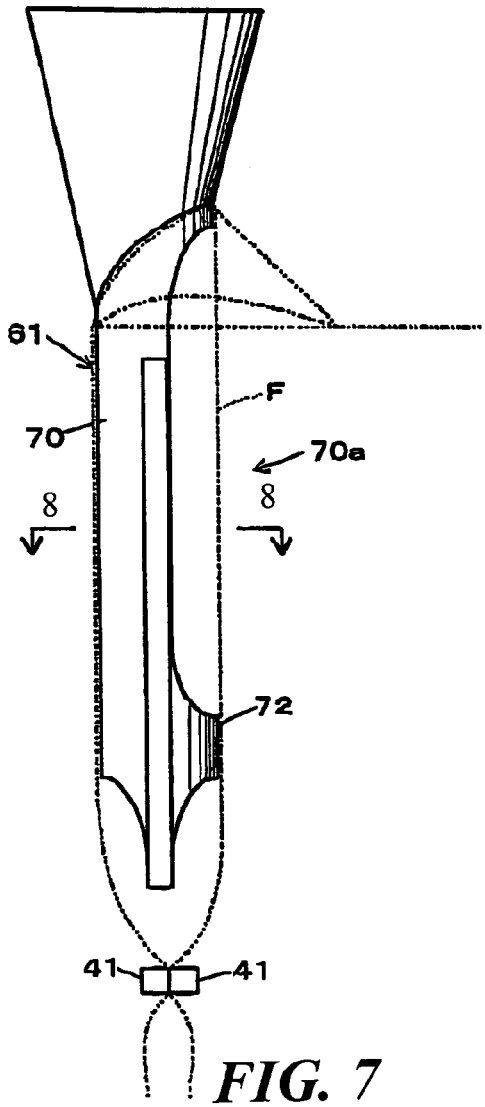
FIG. 7 is a side view for showing the shape of the tube and the film.
Figure 8:
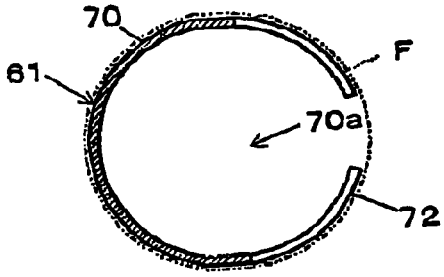
FIG. 8 is a sectional view taken along line 8—8 of FIG. 7.
Figure 9:
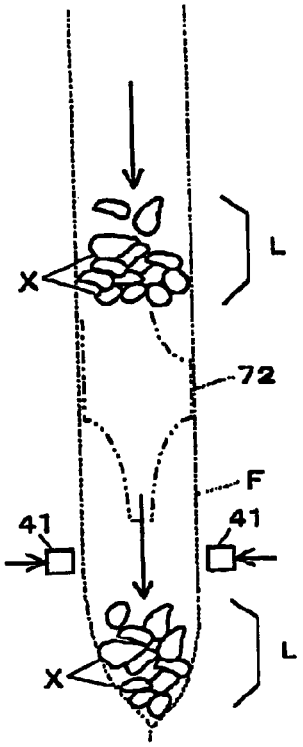
FIG. 9 is a sketch of articles dropping inside the bag shown in FIG. 7.
Figure 14:
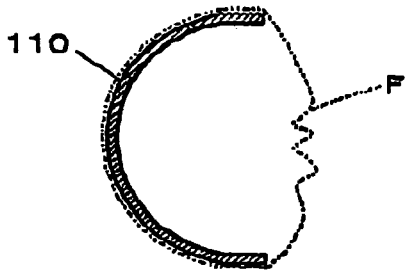
FIG. 14 PRIOR ART
FIG. 14 is a sectional view taken along line 14—14 of FIG. 13.
Figure 15:
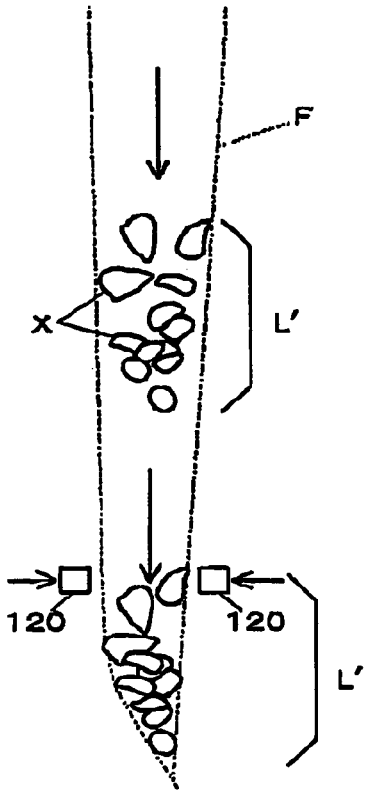
FIG. 15 PRIOR ART
FIG. 15 is a sketch of articles dropping inside a bag being produced by the half-tube of FIG. 11.

The articles which are dropped may clog the interior of the film inside the cylindrical part 61 because of the opening 70*a*, as explained above with reference to FIG. 14. Since the articles are in direct contact with the film near the boundary between the conical part 60 and the cylindrical part 61, however, the clogged condition is forcibly eliminated as the film is pulled downward, as explained above. Moreover, the nearly completely cylindrical portion 72 which is left according to this invention serves to pull the film outward, maintaining its circular cross-sectional shape, as shown in FIGS. 7 and 8. As a result, articles have more cross-sectional room to travel through, as shown in FIG. 9, that is, it is less likely for them to become clogged. In other words, the charge length L of the articles X becomes larger and the batch of articles X can be more easily caused to reach the bottom of the bag being formed. Thus, it becomes less likely to have any articles being caught between the bar members 41 of the transverse sealer 40 and the time interval between successive supplying of articles can be reduced. The production efficiency can be improved accordingly. In other words, there is no need for any stripping in order to prevent the articles from remaining vertically oriented inside the bag and the production routine can be simplified.

If the opening 70*a* is formed such that the upper edge of the nearly completely cylindrical portion 72 is sloped, the articles falling thereonto tend to fall down inside the bag and the clogging can be avoided further effectively.

Since the vertical cut 72*a* is sufficiently narrower than the opening 70*a*, the sectional area of the bag can be kept sufficiently large while its existence allows any clogging articles to be forcibly removed through the cut 72*a*.

Figure 10:
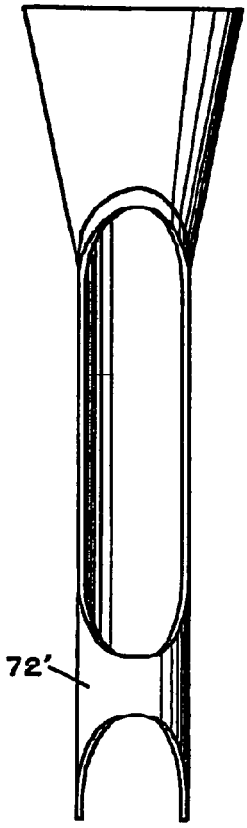
FIG. 10 is a back view of another tube according to another embodiment of the invention.
Figure 11:
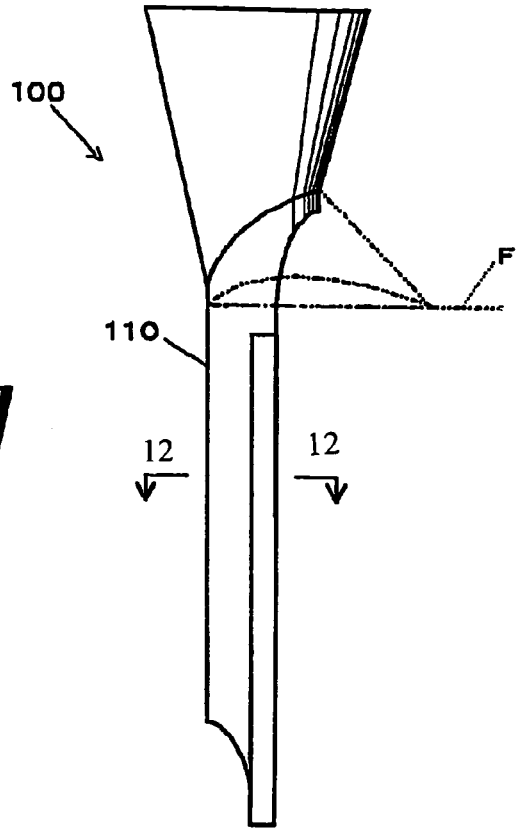
FIG. 11 PRIOR ART
FIG. 11 is a side view of a prior art half-tube.
Figure 12:
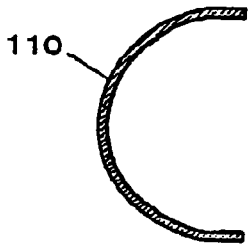
FIG. 12 PRIOR ART
FIG. 12 is a section view taken along line 12—12 of FIG. 11.
Figure 13:
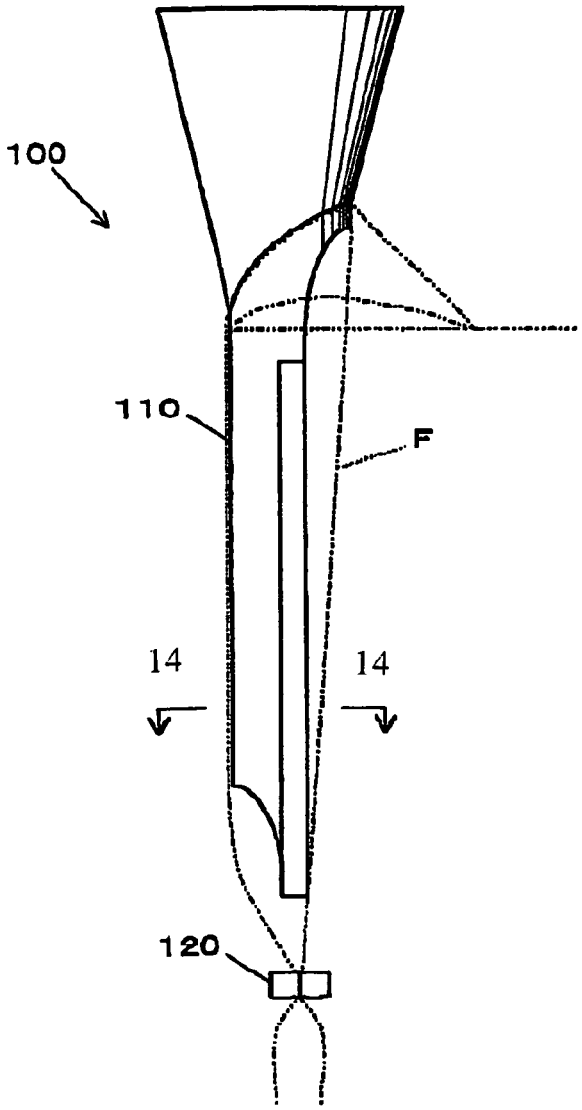
FIG. 13 PRIOR ART
FIG. 13 is a side view of the half-tube of FIG. 11 as it is filling a bag with articles.

FIG. 10 shows another embodiment of this invention characterized wherein the nearly completely cylindrical portion 72 of FIGS. 2–4 is replaced by a completely cylindrical portion 72'. In other words, the cut 72*a* is not provided according to this embodiment. This is because the clogging of articles can be prevented sufficiently dependently if its upper edge is tilted, as explained above, even though no cut is provided.

What is claimed is:

1. A packaging machine comprising:

a former having a guiding member and a tube connected to said guiding member for forming an elongated bag-making material into a tubular form;

a longitudinal sealer disposed on a front side of said tube for sealing mutually overlapping side edge parts of said tubularly formed bag-making material in a longitudinal direction; and a transverse sealer for sealing said longitudinally sealed bag-making material in a transverse direction transverse to said longitudinal direction to thereby package articles dropped down through said tube;

wherein said tube has a conical part which expands conically upward and a cylindrical part which is connected to and extends downward from said conical part, said cylindrical part having an opening on a back surface, said opening extending downward from an upper part of said cylindrical part proximal to said conical part, said cylindrical part having an unopened part near a lower end part.

2. The packaging machine of claim 1 wherein said unopened part has a sloped upper edge.

3. The packaging machine of claim 1 wherein said unopened part has a gap formed from said opening to a lower edge of said unopened part.

4. The packaging machine of claim 2 wherein said unopened part has a gap formed from said opening to a lower edge of said unopened part.

* * * * *